US005954073A

United States Patent [19]

Tobbe et al.

[11] Patent Number: 5,954,073

[45] Date of Patent: Sep. 21, 1999

[54] WASH APPARATUS FOR A DISHWASHER

[75] Inventors: Joseph Duane Tobbe, Taylorsville; Andrew Joseph Spanyer; Larry Barton Curtis, both of Louisvillle, all of Ky.

[73] Assignee: General Electric Company, Louisville, Ky.

[21] Appl. No.: 08/996,242

[22] Filed: Dec. 22, 1997

[51] Int. Cl.[6] ..... B08B 3/02

[52] U.S. Cl. ..... 134/176; 134/174; 134/182; 134/183

[58] Field of Search ..... 134/56 D, 57 D, 134/58 D, 198, 176, 179, 200, 182, 183; 239/524

[56] References Cited

U.S. PATENT DOCUMENTS

| | | | |
|---|---|---|---|
| 1,335,853 | 4/1920 | Myrick . | |
| 1,863,914 | 6/1932 | Tyler . | |
| 1,926,651 | 9/1933 | Rombach . | |
| 2,279,374 | 4/1942 | Jung . | |
| 3,180,348 | 4/1965 | Clearman . | |
| 3,288,156 | 11/1966 | Jordan et al. | 134/176 |
| 3,319,640 | 5/1967 | La Flame | 134/148 |
| 3,368,573 | 2/1968 | Mixon . | |
| 3,496,949 | 2/1970 | Mercer | 134/179 |
| 3,538,927 | 11/1970 | Wallgren . | |
| 3,809,106 | 5/1974 | Crabtree | 134/176 |
| 3,951,684 | 4/1976 | Laprad et al. . | |
| 3,969,137 | 7/1976 | Jenkins et al. | 134/176 |
| 5,546,968 | 8/1996 | Jeon et al. | 134/179 |

FOREIGN PATENT DOCUMENTS

| | | | |
|---|---|---|---|
| 1628711 | 8/1971 | Germany | 134/179 |
| 3914760 | 11/1990 | Germany | 134/56 D |

*Primary Examiner*—Frankie L. Stinson
*Attorney, Agent, or Firm*—H. Neil Houser

[57] ABSTRACT

A dishwasher including a third level washing apparatus which is low cost and effective in spraying water over the upper rack of the dishwasher is described. More particularly, and in one embodiment, the dishwasher includes a rotatable arm mounted in the dishwasher tub below the lower rack for providing first level washing, and a retractable tower secured to, and rotatable with, the rotatable arm and positioned to extend through the lower rack when fully extended. The retractable tower provides second level washing. The dishwasher also includes a third level wash apparatus having a base secured to the upper rack and an elongate body extending from the base. A water passage extends through the base and elongate body. In one embodiment, a spray member is spaced from an open outlet end of the elongate body, and at least one support member extends from the elongate body to the spray member for supporting the spray member at an elevation above the upper rack. In one specific embodiment, the retractable tower includes an uppermost, substantially cylindrical section having a sidewall with a plurality of water outlet ports. A water jet outlet is located at an outlet end of the uppermost section, and the water jet outlet is oriented so that when water flows out from the water jet outlet, the water is directed through the third level washing apparatus elongate body and flows against the spray member. The water flows out from the water jet outlet substantially along an axis which is off-center with respect to the spray member so that as the tower rotates, the water spray from the spray member rotates, or orbits, within the wash chamber over the upper rack to provide third level washing.

32 Claims, 3 Drawing Sheets

12
14
20
22
30
32
34
46
48
52A
52B
52C
54
64
80
82
84
86
10

WASH APPARATUS FOR A DISHWASHER

FIELD OF THE INVENTION

This invention relates generally to dishwashers and, more particularly, to a wash apparatus providing spray both below and above the upper rack of a dishwasher.

BACKGROUND OF THE INVENTION

Known dishwashers include a cabinet having an access door hinged at its lower end to pivot on a horizontal axis and open outwardly from the cabinet. The cabinet includes a wash chamber, and lower and upper dishwashing racks are vertically mounted within the wash chamber. The racks can be slidably withdrawn outwardly through an access opening.

Washing systems utilized in known dishwashers include first level, second level, and third level type systems. A first level washing system sprays water from below the lower rack up into dishes located on the lower rack. A typical first level washing system includes a rotatable arm mounted below the lower rack and having a plurality of spray openings. The spray openings face upward towards the lower rack. In operation, as the rotatable arm rotates water is supplied to the arm and is sprayed out from the arm through the spray openings.

A second level washing system, in addition to first level washing, sprays water to the underside of the upper rack. A typical second level washing system includes a retractable tower which, when supplied with water, extends through and at least partially above the lower rack. The retractable tower includes openings in its side surface near its uppermost end, and water under pressure flows through the openings and up into dishes and cups located on the upper rack.

A third level washing system, in addition to first and second level washing, sprays water above the upper rack. A typical third level washing system includes a rotatable arm mounted above the upper rack, e.g., to the top wall of the tub, and has a plurality of spray openings. The spray openings face downward towards the upper rack. In operation, as the rotatable arm rotates, water is supplied to the arm and is sprayed out from the arm through the spray openings and into the dishes and cups on the upper rack.

Of course, a dishwasher including a third level washing system typically is more expensive to manufacture, in terms of both component and assembly costs, than a dishwasher including first or second level washing systems. It would be desirable to reduce the cost of third level washing systems since such systems are believed to provide the most effective washing.

Further, with respect to dishwashers incorporating third level washing systems, such dishwashers typically utilize more water during a wash cycle than dishwashers with just first or second level washing systems. Therefore, a dishwasher including a third level washing system typically is more expensive to operate than a dishwasher including just first or second level washing systems. It would be desirable to reduce the operating cost of third level washing systems.

In addition to the costs associated with known third level dishwashing systems, another concern relates to blockage of spray openings in the tower under the upper rack. The tower typically has large diameter spray openings to prevent soil from blocking the spray openings. To spray water on the underside of the upper rack for second level washing, however, smaller diameter spray openings generally are preferred. With small diameter tower openings, the magnitude of noise generated when water flows onto the dishwasher door and tub is lower than the magnitude of noise which results with larger openings. Particularly in a residential dishwasher which typically is located in the living area of a residence, it is desirable to decrease the magnitude of noise generated by the dishwasher.

SUMMARY OF THE INVENTION

These and other objects may be attained in a dishwasher having a third level washing apparatus which is low cost and effective in spraying water over the upper rack of the dishwasher. More particularly, and in one embodiment, the dishwasher includes a rotatable arm mounted in the dishwasher tub below the lower rack for providing first level washing, and a retractable tower secured to, and rotatable with, the rotatable arm and positioned to extend through the lower rack. The retractable tower provides second level washing.

The dishwasher also includes a third level wash apparatus having a base secured to the upper rack and an elongate body extending from the base. A water passage extends through the base and elongate body. In one embodiment, a spray member is spaced from an open outlet end of the elongate body, and at least one support member extends from the elongate body to the spray member for supporting the spray member at an elevation above the upper rack.

In one specific embodiment, the retractable tower includes an uppermost, substantially cylindrical section having a sidewall with a plurality of water outlet ports. A water jet outlet is located at an outlet end of the uppermost section, and the water jet outlet is oriented so that when water flows out from the water jet outlet, the water is directed through the third level washing apparatus elongate body and flows against the spray member. The water flows out from the water jet outlet substantially along an axis which is off-center with respect to the spray member so that as the tower rotates, the water spray from the spray member rotates, or orbits, within the wash chamber over the upper rack to provide third level washing. The water jet outlet is sufficiently large so that soil can be exhausted through the outlet. By selecting the water jet outlet to be large, the water outlet ports can have a smaller size without resulting in clogging.

The water outlet ports in the tower uppermost section are configured so that water flows out from the ports at different angular orientations. The water spray from each water tower port, therefore, is directed toward different sections of the underside of the upper rack. As a result, and as the tower rotates, the water from the outlet ports creates a swath of water which sprays against an underside of dishes and cups located in the upper rack.

In one embodiment, the third level wash apparatus elongate body has a substantially cylindrical shape, and an open end of the elongate body at the base has a larger diameter than the open outlet end of the elongate body. In addition, the spray member, in one form, is a substantially flat disk, and spaced support ribs extend from the elongate body outlet end to the disk to support the disk over the outlet.

The above described washing system is believed to be lower in cost than known third level washing systems, particularly since in the present system, the rotating arm located over the upper rack is eliminated yet third level washing is provided. In addition, since the third level washing apparatus can be easily and readily snapped to the upper rack, the time consuming and cumbersome assembly process required with some known third level washing systems is substantially eliminated.

Further, by eliminating the rotatable arm over the upper rack, the amount of water utilized in the present system to provide third level washing is believed to be less than the amount of water required in some known third level washing systems. Therefore, not only are component and assembly costs reduced, but the present system provides reduced operating costs.

In addition to the cost advantages described above, in the present wash system, the water outlet ports in the tower can have smaller diameters than the openings in the towers used in some known third level wash systems. By having small diameter ports, the noise associated with the present third level wash system is believed to be less than the noise associated with such known third level washing systems.

DETAILED DESCRIPTION

Figure 1:
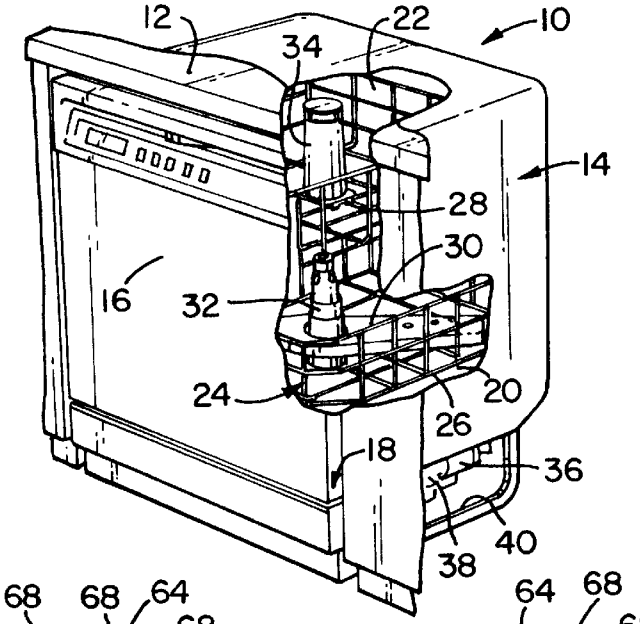
FIG. 1 is a perspective view of an under-the-counter type dishwasher with portions of dishwasher cut away.

FIG. 1 is a perspective view of an under-the-counter type dishwasher 10 with portions of a counter 12 cut away. Dishwasher 10 includes a cabinet 14 having an access door 16 hinged at its lower end 18 to pivot on a horizontal axis and open outwardly from cabinet 14. A tub 20 is positioned within cabinet 14 and forms a wash chamber 22. Tub 20 includes an access opening 24, and access door 16 is hinged to swing downwardly away from access opening 24. Lower and upper dishwashing racks 26 and 28 are vertically mounted within wash chamber 22. Racks 26 and 28 can be slidably withdrawn outwardly through access opening 24.

Dishwasher further includes a rotatable arm 30 mounted in tub 20 below lower rack 26, and a retractable tower 32 is mounted to, and rotatable with, arm 30 for spraying water within wash chamber 22. In addition, and in accordance with one embodiment of the present invention, dishwasher 10 includes a third level wash apparatus 34 extending above upper rack 28. A water pump motor 36 and a water pump 38 are positioned in a chamber 40 below tub 20.

Dishwashers, such as dishwasher 10, are well known and commercially available from General Electric Company, Appliance Park, Louisville, Ky. 40225. Such known dishwashers can be modified to include third level wash apparatus 34, which is described below in more detail.

Figure 2:
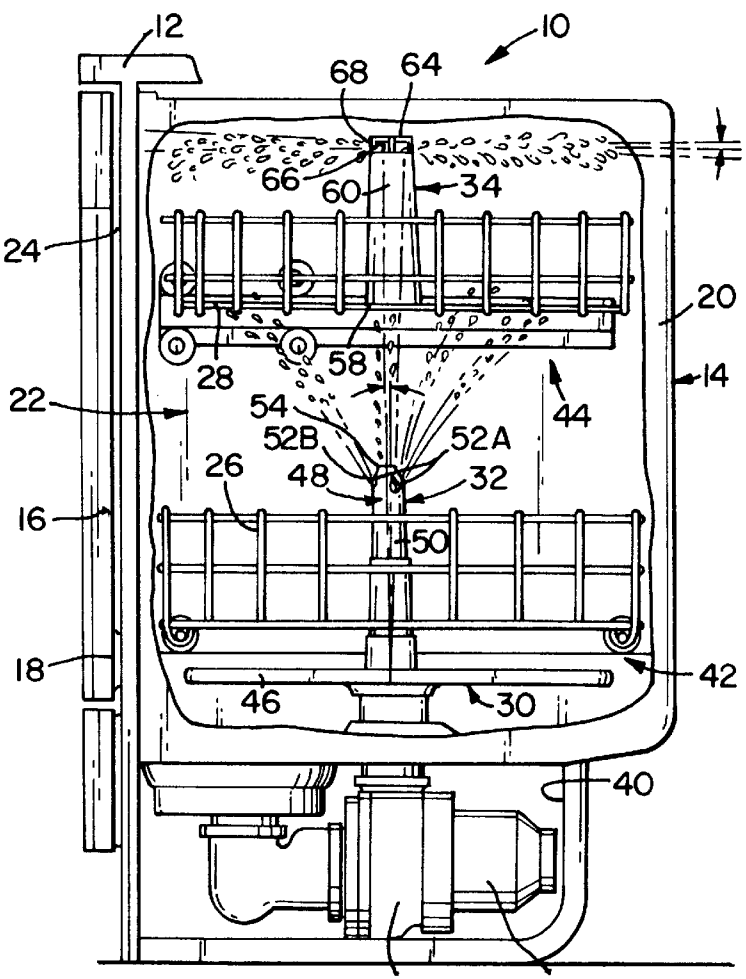
FIG. 2 is a side view of the dishwasher shown in FIG. 1 with a portion of the dishwasher cabinet cut away.

FIG. 2 is a side view of dishwasher 10 shown in FIG. 1 with a portion of dishwasher tub 20 cut away. As shown in FIG. 2, lower and upper racks 26 and 28 are supported on respective support assemblies 42 and 44 so that racks 26 and 28 can be withdrawn and positioned within wash chamber 24. Importantly, third level washing apparatus 34 and retractable tower 32 do not interfere with withdrawing racks 26 and 28. Specifically, apparatus 34 is secured to upper rack 28 and travels with rack 28. Apparatus 34 has sufficient clearance so that it easily passes through access opening 24 with upper rack 28. In addition, and when water is not flowing through retractable tower 32, tower 32 collapses so that tower 32 is completely located below lower rack 26.

As shown in FIG. 2, rotatable arm 30 includes a longitudinally extending member 46 having a plurality of spray openings (not shown) for spraying water within wash chamber 22. Rotatable arm 30 is mounted in dishwasher tub 20 below lower rack 26 for providing first level washing Retractable tower 32 is secured to, and rotates with, arm 30. Rotating arms and retractable towers are known in the art. In the present construction, however, retractable tower 32 includes an uppermost, substantially cylindrical section 48 having a sidewall 50 with a plurality of water outlet ports 52A, 52B, and 52C (port 52C is not visible in FIG. 2). Water flows out from ports 52A, 52B, and 52C and provides second level washing.

A water jet outlet 54 is located at an outlet end 56 of uppermost section 48, and water jet outlet 54 is oriented so that when water flows out from water jet outlet 54, the water is directed through third level washing apparatus 34, as described below. The water flows out from water jet outlet 54 substantially along an axis which is off-center with respect to the center axis of apparatus 34.

Third level wash apparatus 34 has a base 58 secured to upper rack 28 and an elongate body 60 extending from base 58. A water passage 62 extends through base 58 and elongate body 60. A spray member 64 having a substantially flat spray surface is spaced from an open outlet end 66 of elongate body 60, and support members 68, e.g., ribs, extend from elongate body 60 to spray member 64 for supporting spray member 64 at an elevation above upper rack 28.

With respect to apparatus 34, and in operation, as the tower 32 rotates, the water jet from water jet outlet 54 is directed through water passage 62 and flows against the flat spray surface of spray member 64. When the water impacts against spray member 64, the water is directed out through the space between outlet end 66 and spray member 64 and over the dishes and cups in upper rack 28. The water flows out from water jet outlet 54 substantially along an axis which is off-center with respect to the center axis of apparatus 34, and the spray from spray member 64 rotates, or orbits, within wash chamber 22 as tower 32 rotates.

Figure 3:
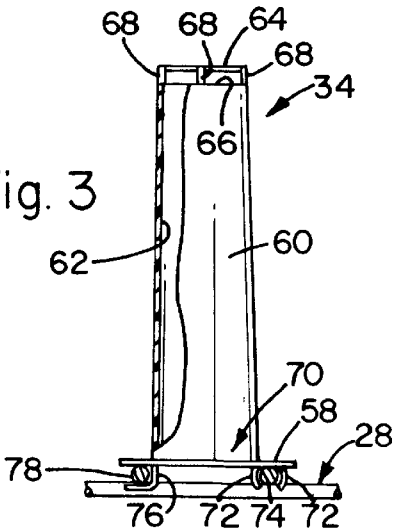
FIG. 3 is a side view of the third level wash apparatus shown in FIGS. 1 and 2.

FIG. 3 is a side view of third level wash apparatus 34. Third level wash apparatus elongate body 60 has a substantially cylindrical shape, and an open end 70 of elongate body 60 at base 58 has a larger diameter than open outlet end 66. In addition, spray member 64, in the illustrated form, is a substantially flat disk, and spaced support ribs 68 extend from elongate body outlet end 66 to disk 64 to support disk 64 over outlet end 66. Further, base 58 includes clips 72 which snap over a wire 74 of upper rack 28 and reverse L-shaped lead-in members, or fingers, 76 which receive a portion of an upper rack wire 78. Clips 72 and lead-in members 76 facilitate easily and quickly securing apparatus 34 to upper rack 28. The particular dimensions selected for clips 72 and members 76 depend upon a number of factors such as the material from which upper rack wire 78 is fabricated and the material from which clips 72 and members 76 are fabricated. Alternative structures can, of course, be used to secure apparatus 34 to upper rack wire 78.

Figure 4:
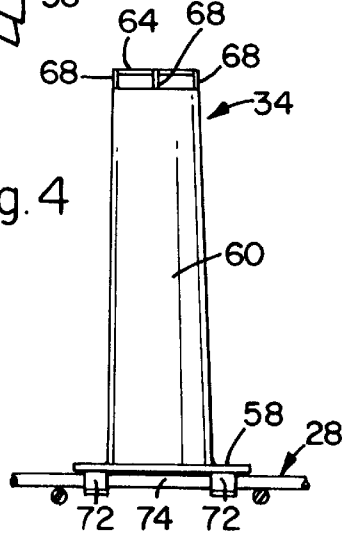
FIG. 4 is a front view of the third level wash apparatus shown in FIG. 3.

FIG. 4 is a front view of third level wash apparatus 34 shown in FIG. 3. As shown in FIG. 4, two sets of clips 72 are utilized to secure apparatus 34 to wire 74. Similarly, although not shown in FIG. 4, two lead-in members 76 opposing clips 72 further facilitate securing apparatus 34 to wire 78 (FIG. 3).

Third level washing apparatus base 58, elongate body 60, spray member 64, and support members 68, in one form, are integral. Apparatus 34 can be formed, for example, in an injection molding process using a plastic.

Figures 5, 6, 7, 8, 9, 10:
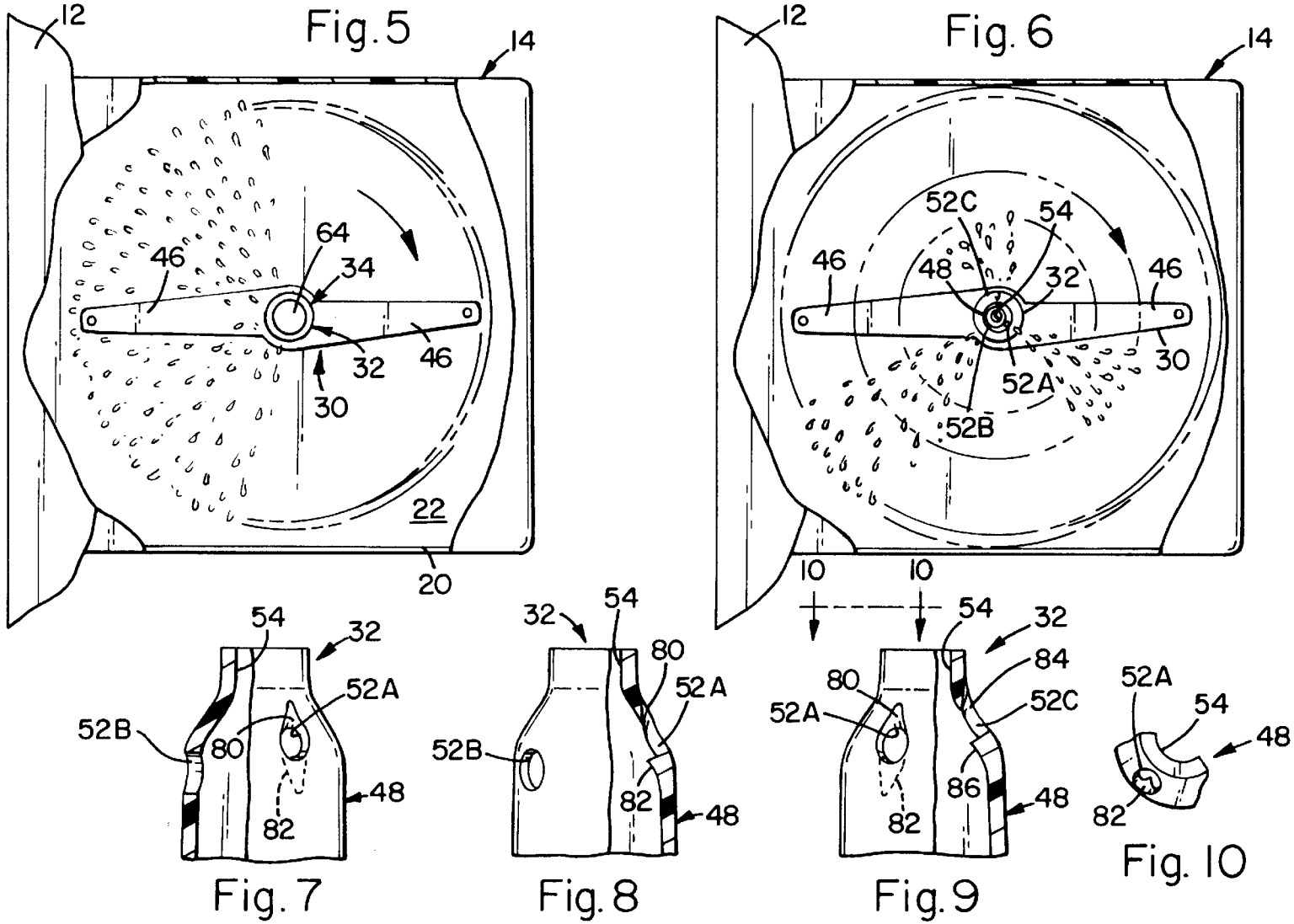
FIG. 5 is a top view of the dishwasher shown in FIG. 2 with a portion of the dishwasher cabinet cut away.
FIG. 6 is a top view of the dishwasher shown in FIG. 5 with the third level wash apparatus removed.
FIG. 7 is a partial cross sectional view of the retractable tower shown in FIG. 6.
FIG. 8 is a partial cross sectional view of the retractable tower shown in FIG. 7.
FIG. 9 is a partial cross sectional view of the retractable tower shown in FIG. 8.
FIG. 10 is a partial cross sectional view of the retractable tower through line 10—10 shown in FIG. 9.

FIG. 5 is a top view of dishwasher 10 with a portion of dishwasher cabinet 14 and tub 20 cut away. As shown in FIG. 5, as arm 30 rotates (e.g., clockwise), spray from apparatus 34 is directed to over approximately about one half of tub 20. As arm 30 continues to rotate, the direction of spray from apparatus 34 also rotates so as to cover the entire area of tub 20 over upper rack 28 (not shown in FIG. 5).

With respect to flow from tower 32, and referring to FIG. 6 which is a top view of dishwasher 10 with third level wash apparatus 34 removed, water outlet ports 52A, 52B, and 52C in tower uppermost section 48 are configured so that water flows out from ports 52A, 52B and 52C at different angular orientations. The water spray from each water tower port 52A, 52B, and 52C, therefore, is directed toward different sections of the underside of the upper rack 28 (not shown in FIG. 6). As a result, and as tower 32 rotates, the water from outlet ports 52A, 52B, and 52C creates a broad swath of water which sprays against an underside of dishes and cups located in upper rack 28.

FIG. 7 is a partial cross sectional view of upper section 48 of retractable tower 32 shown in FIG. 6. Ports 52A and 52B are shown in FIG. 7, and port 52A is shown as including a flared section 80. A projection, generally indicated at 82, is located upstream of port 52A on an inner surface of upper section 48. Projection 82 serves to provide more of a water stream, rather than a spray, from port 52A. Port 52A also has a different angular orientation than port 52B. By providing different angular orientations for ports 52A and 52B, water flows out from ports 52A and 52B at different angular orientations and thus is directed toward different sections of the underside of the upper rack 28.

FIG. 8 is a partial cross sectional view of upper section 48 of retractable tower 32 and illustrates port 52A in cross section. Projection 82 is in the form of a ridge and affects flow from port 52A as described above.

FIG. 9 is a partial cross sectional view of upper section 48 of retractable tower 32 and illustrates ports 52A and 52C. Port 52 C also includes a flared section 84 and a projection 86 identical to projection 82 of port 52A. Port 52C has a different angular orientation than port 52A, and by providing different angular orientations for ports 52C and 52A, water flows out from ports 52C and 52A at different angular orientations and thus is directed toward different sections of the underside of the upper rack 28.

FIG. 10 is a partial cross sectional view of upper section 48 of retractable tower 32 through line 10—10 shown in FIG. 9. As shown in FIG. 10, projection 82 has an inverted tapered—v cross sectional shape. This shape is selected to provide more of a water stream, rather than a spray, from port 52A. Port 52B includes projection 86 which is identical to projection 82.

Figure 11:
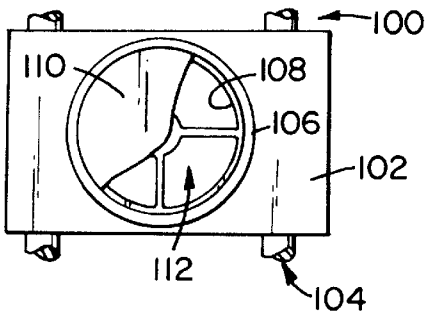
FIG. 11 is a top view of a third level wash apparatus in accordance with another embodiment of the present invention.

FIG. 11 is a top view of a third level wash apparatus 100 in accordance with another embodiment of the present invention. Third level wash apparatus 100 has a base 102 secured to an upper rack 104 and an elongate body 106 extending from base 102. A water passage 108 extends through base 102 and elongate body 106. A spray member 110 having a substantially flat spray surface is positioned over an open outlet end 112 of elongate body 106. A cross-shaped support member 114 extends over end 112 and spray member 110 rests on member 114 when washing operations are not active.

Figure 12:
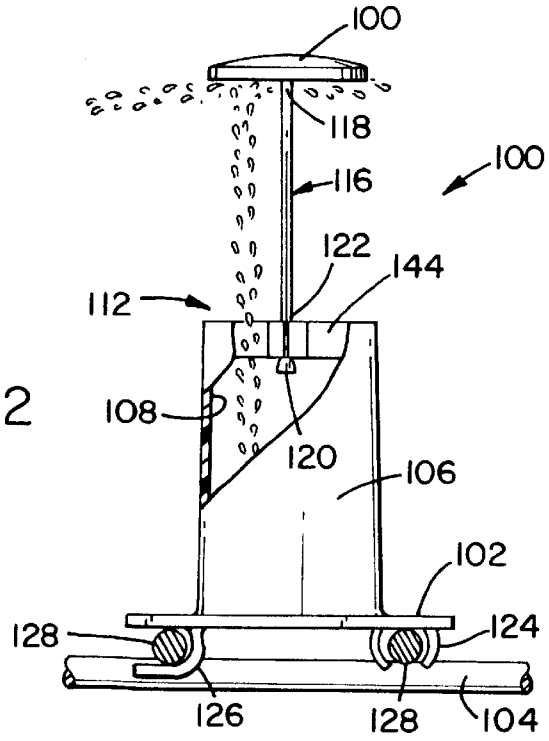
FIG. 12 is a side view of the third level wash apparatus shown in FIG. 11.

FIG. 12 is a side view of third level wash apparatus 100, and as shown in FIG. 12, spray member 110 is secured to a rod 116. Specifically, one end 118 of rod 116 is secured to spray member 110, and an opposing end 120 of rod 116 is crimped. Rod 116 extends through an opening 122 in support member 114 and crimped end 120 of rod 116 limits the upward movement of rod 116 through opening 122.

Clips 124 and reverse L-shaped lead-in members, or fingers, 126 secure apparatus 100 to wires 128 of upper rack 104. To secure apparatus 104 to rack 104, apparatus 100 is initially oriented so that fingers 126 slide under a selected wire 128, and then apparatus is rotated so that clips 124 snap into engagement with another wire 128 of rack 104. Clips 124 and fingers 126 enable easy installation and removal of third level wash apparatus 100. The particular dimensions selected for clips 124 and fingers 126 depend upon a number of factors such as the material from which upper rack wire 128 is fabricated and the material from which clips 124 and fingers 126 are fabricated. Alternative structures can, of course, be used to secure apparatus 100 to upper rack wire 128.

Apparatus 100 may be used in conjunction with tower 32. Specifically, and in operation, as the tower 32 rotates, the water jet from water jet outlet 54 is directed through water passage 108 and flows against the flat spray surface of spray member 110. When the water impacts against spray member 110, member 110 is forced upward until crimped end 120 of rod 116 prevents further upward movement. The water which impacts against the spray surface of member 110 is directed out over the dishes and cups in upper rack 104. The water flows out from water jet outlet 54 substantially along an axis which is off-center with respect to the center axis of apparatus 100, and the spray from spray member 110 rotates, or orbits, within the wash chamber.

Figure 13:
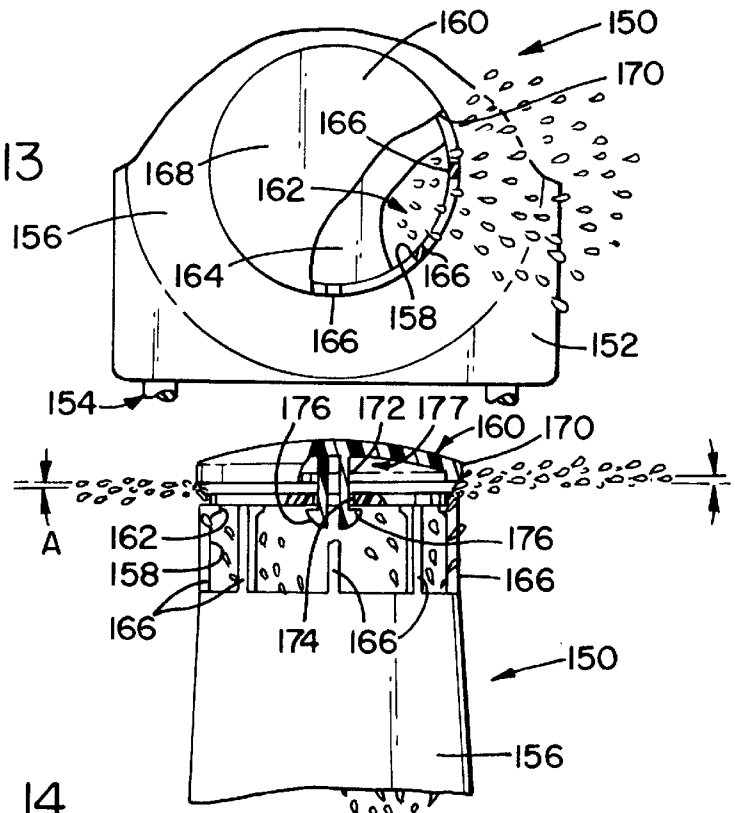
FIG. 13 is a top view of a third level wash apparatus in accordance with yet another embodiment of the present invention.

FIG. 13 is a top view of a third level wash apparatus 150 in accordance with yet another embodiment of the present invention. Third level wash apparatus 150 has a base 152 secured to an upper rack 154 and an elongate body 156 extending from base 152. A water passage 158 extends through base 152 and elongate body 156. A spray member 160 is positioned over an open outlet end 162 of elongate body 156. Spray member 160 includes a substantially flat stationary disk 164 secured to elongate body 156 by spaced support ribs 166. Ribs 166 extend from elongate body outlet end 162 to disk 164 to support disk 164 over outlet end 162. Spray member 160 also includes a cover 168 coupled to stationary disk 164. Cover 168 has a peripheral edge 170 which extends over the outer periphery of disk 164 and outlet end 162 of elongate body 156.

Figure 14:
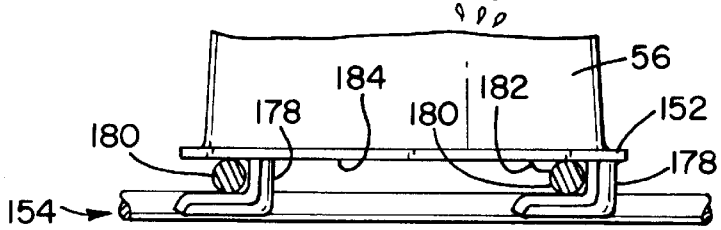
FIG. 14 is a side view of the third level wash apparatus shown in FIG. 13.

FIG. 14 is a side view of third level wash apparatus 150 shown in FIG. 13. As shown in FIG. 14, cover 168 includes a prong 172 which extends through an opening 174 in disk 164. Ledges 176 on the end of prong 172 maintain cover 168 in engagement with disk 164 during wash operations. A cover inner cavity 177 of cover 168 is provided to enable cover 168 to tilt, or wobble, relative to disk 164. Such wobbling of cover 168 facilitates in creating a desired spray pattern as described below. Cover 168 can be readily separated from disk 164 by an operator for cleaning. As described above, peripheral edge 170 of cover 168 extends over the outer periphery of outlet end 162 of elongate body 156 so that even water which is flowing upward at the periphery of outlet end 162 is directed out over upper rack 154 by spray member 160.

Reverse L-shaped lead-in members, or fingers, 178 secure apparatus 150 to wires 180 of upper rack 154. To secure apparatus 150 to rack 154, apparatus 150 is initially oriented so that fingers 178 slide under a selected wires 180, and then apparatus 150 is rotated so that wire 180 snaps under a nub, or projection, 182 extending from a surface 184 of base 152. Fingers 178 enable easy installation and removal of third level wash apparatus 150. The particular dimensions selected for fingers 178 depend upon a number of factors such as the material from which upper rack wire 180 is fabricated and the material from which fingers 178 are fabricated. Alternative structures can, of course, be used to secure apparatus 150 to upper rack wire 180.

Apparatus 150 may be used in conjunction with tower 32. Specifically, and in operation, as the tower 32 rotates, the water jet from water jet outlet 54 is directed through water passage 158 and flows against the flat spray surface of spray member 160. Specifically, the water flows against the flat spray surface of disk 164. Also, water flowing from the periphery of outlet end 162 flows against peripheral edge 170 of cover 168 and is directed out over upper rack 154.

As shown in FIG. 14, since cover 168 may tilt, or wobble, relative to disk 164, as water flows from jet outlet 54 along an axis which is off-center with respect to the center axis of apparatus 100, the water sprays out from spray member 160 at different angular orientations as indicated by angles A and B. Such different, or varying, angular orientation facilitates creating a swath of water which orbits within the wash chamber over the upper rack.

The above described washing systems are believed to be lower in cost than known systems including third level washing, particularly since the rotating arm located over the upper rack is eliminated yet third level washing is provided. In addition, since the third level washing apparatus can be easily and readily snapped to the upper rack, the time consuming and cumbersome assembly process required with some known third level washing systems is eliminated. Further, by eliminating the rotatable arm over the upper rack, the amount of water utilized in the present systems to provide third level washing is believed to be less than the amount of water required in some known third level washing systems. Therefore, not only are component and assembly costs reduced, but the present systems provide reduced operating costs.

In addition to the cost advantages described above, in the present wash systems, the water outlet ports in the tower can have smaller diameters than the openings in the towers used in some known third level wash systems. By having smaller diameter ports, the noise associated with the present third level wash system is believed to be less than the noise associated with known third level washing systems.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

We claim:

1. A third level wash apparatus for a dishwasher including an upper rack, said third level washing apparatus comprising a base configured to be secured to the rack, an elongate body extending from said base, a water passage extending through said base and said elongate body, and a spray member positioned over an open outlet end of said elongate body and having a substantially flat spray surface, said spray member comprising a disk and a cover secured to said disk, said cover movable relative to said disk.

2. A third level wash apparatus in accordance with claim 1 wherein said spray member is spaced from said open outlet end of said elongate body, and a support member extends from said elongate body to said spray member for supporting said spray member.

3. A third level wash apparatus in accordance with claim 1 further comprising a rod secured to said spray member, and a support member extends over said open outlet end of said elongate body, said support member having an opening therethrough, and said rod extends through said support member opening.

4. A third level washing apparatus in accordance with claim 1 wherein said base comprises a plurality of fingers for engaging wires forming the upper rack.

5. A third level washing apparatus in accordance with claim 1 wherein said elongate body has a substantially cylindrical shape.

6. A third level washing apparatus in accordance with claim 5 wherein an open end of said elongate body at said base has a larger diameter than said open outlet end of said elongate body.

7. A third level wash apparatus in accordance with claim 1 wherein said cover comprises an edge which extends over an outer periphery of said disk and a prong for securing said cover to said disk.

8. A third Level washing apparatus in accordance with claim 1 wherein said support member comprises a support rib extending from said open outlet end of said elongate body to said spray member for supporting said spray member.

9. A dishwasher comprising:

a cabinet having an access door hinged at its lower end to pivot on a horizontal axis and open outwardly from said cabinet;

a tub positioned within said cabinet and forming a wash chamber, said tub having an access opening, said access door hinged to swing downwardly away from said access opening;

an upper rack vertically positioned within said wash chamber and slidable relative to said tub so that said upper rack can be slidably withdrawn outwardly through said access opening and retracted into said chamber;

an lower rack vertically positioned within said wash chamber and slidable relative to said tub so that said lower rack can be slidably withdrawn outwardly through said access opening and retracted into said chamber, said lower rack positioned at an elevation below said upper rack;

a rotatable arm mounted in said tub below said lower rack;

a retractable tower secured to said rotatable arm and positioned to extend through said lower rack when fully extended; and a third level washing apparatus comprising a base secured to said upper rack, an elongate body extending from said base, a water passage extending through said base and said elongate body, and a spray member positioned over an open outlet end of said elongate body and having a substantially flat spray surface, a plurality of spaced support members extending from said elongate body to said spray member.

10. A dishwasher in accordance with claim 9 wherein said spray member of said third level washing apparatus is spaced from said open outlet end of said elongate body.

11. A dishwasher in accordance with claim 9 wherein said third level washing apparatus comprises a rod secured to said spray member, and a support member extends over said open outlet end of said elongate body, said support member having an opening therethrough, and said rod extends through said support member opening.

12. A dishwasher in accordance with claim 9 wherein said retractable tower comprises an uppermost, substantially cylindrical section having a sidewall with a plurality of water outlet ports, and a water jet outlet at an outlet end of said uppermost section oriented so that when water flows out from said water jet outlet, the water is directed through said elongate body and flows against said spray member.

13. A dishwasher in accordance with claim 12 wherein said water outlet ports are configured so that water flows out from at least two of said ports at a different angular orientations.

14. A dishwasher in accordance with claim 12 wherein an extension is located upstream of at least one of said ports on an inner wall of said uppermost section, said extension comprising a ridge which extends into a flow path through said uppermost section, said ridge having an inverted tapered v-cross sectional shape.

15. A dishwasher in accordance with claim 9 wherein said third level wash apparatus base comprises a plurality of fingers for engaging wires forming said upper rack.

16. A dishwasher in accordance with claim 9 wherein said third level wash apparatus elongate body has a substantially cylindrical shape, an open end of said elongate body at said base having a larger diameter than said open outlet end of said elongate body.

17. A dishwasher in accordance with claim 9 wherein said third level washing apparatus spray member comprises a disk.

18. A dishwasher in accordance with claim 17 wherein said spray member further comprises a cover secured to said disk, said cover movable relative to said disk, said cover comprising an edge which extends over an outer periphery of said disk and a prong for securing said cover to said disk.

19. Apparatus for a dishwasher including an upper rack, said apparatus comprising a base configured to be secured to the rack, an elongate body integral with and extending from said base, said elongate body comprising an open outlet end, a water passage extending through said base and said elongate body, and a spray member spaced from and at least partially extending over said open outlet end of said elongate body, said spray member comprising a substantially flat spray surface integral with said elongate body, and a cover movable relative to said spray surface.

20. Apparatus in accordance with claim 19 further comprising a support member extending from said elongate body to said spray member for supporting said spray member.

21. Apparatus in accordance with claim 19 wherein said base comprises a plurality of fingers for engaging wires forming the upper rack.

22. Apparatus in accordance with claim 19 wherein said elongate body has a substantially cylindrical shape.

23. Apparatus in accordance with claim 19 wherein an open end of said elongate body at said base has a larger diameter than said open outlet end of said elongate body.

24. Apparatus in accordance with claim 19 wherein said spray member comprises a disk.

25. Apparatus in accordance with claim 24 wherein said cover is secured to said disk.

26. Apparatus in accordance with claim 25 wherein said cover comprises an edge which extends over an outer periphery of said disk and a prong for securing said cover to said disk.

27. Apparatus in accordance with claim 19 wherein said support member comprises a support rib extending from said open outlet end of said elongate body to said spray member for supporting said spray member.

28. A third level wash apparatus for a dishwasher including an upper rack, said third level washing apparatus comprising a base configured to be secured to the rack, an elongate body extending from said base, a water passage extending through said base and said elongate body, a spray member positioned over an open outlet end of said elongate body and having a substantially flat spray surface, a rod secured to and movable with said spray member, and a support member extending over said open outlet end of said elongate body, said support member having an opening therethrough, said rod extending through said support member opening.

29. A third level washing apparatus in accordance with claim 28 wherein said base comprises a plurality of fingers for engaging wires forming the upper rack.

30. A third level washing apparatus in accordance with claim 28 wherein said elongate body has a substantially cylindrical shape.

31. A third level washing apparatus in accordance with claim 28 wherein an open end of said elongate body at said base has a larger diameter than said open outlet end of said elongate body.

32. A third level washing apparatus in accordance with claim 28 wherein said spray member comprises a disk.

* * * * *